US007033047B2

(12) United States Patent
Gennrich et al.

(10) Patent No.: US 7,033,047 B2
(45) Date of Patent: Apr. 25, 2006

(54) COMPACT SHUTTER ASSEMBLY FOR A LUMINAIRE

(75) Inventors: David J. Gennrich, Madison, WI (US); Sheldon Roberts, Sun Prairie, WI (US)

(73) Assignee: Electronic Theatre Controls, Inc., Middleton, WI (US)

( * ) Notice: Subject to any disclaimer, the term of this patent is extended or adjusted under 35 U.S.C. 154(b) by 0 days.

(21) Appl. No.: 10/897,825

(22) Filed: Jul. 22, 2004

(65) Prior Publication Data

US 2005/0047148 A1 Mar. 3, 2005

Related U.S. Application Data

(63) Continuation-in-part of application No. 10/651,273, filed on Aug. 28, 2003.

(51) Int. Cl.
*F21V 17/02* (2006.01)

(52) U.S. Cl. ..... 362/321; 362/277; 362/283; 362/322

(58) Field of Classification Search ..... 362/552, 362/293, 277, 281, 321, 283, 284, 322, 323
See application file for complete search history.

(56) References Cited

U.S. PATENT DOCUMENTS 5,398,408 A 3/1995 Bernet
5,510,969 A * 4/1996 Rodger et al. ..... 362/321
6,102,554 A * 8/2000 Wynne Willson et al. .. 362/281
6,550,939 B1 4/2003 Reinert ..... 362/321
6,837,596 B1 * 1/2005 Tanaka et al. ..... 362/277
2002/0060911 A1 5/2002 Brockmann et al.

OTHER PUBLICATIONS

PCT International Search Report and Written Opinion of the International Searching Authority, Jun. 29, 2005; PCT/US04/26099.

* cited by examiner

*Primary Examiner*—Y. My Quach-Lee
*Assistant Examiner*—Peggy A. Neils
(74) *Attorney, Agent, or Firm*—Greer, Burns & Crain, Ltd.; Philip M. Kolehmainen

(57) ABSTRACT

A shutter section includes a stack of circular plates independently rotatable in a nest formed as a laminar formation of rings. The plates have central openings defining a light path. Four central plates in the stack are shutter guide plates with radial guide slots slideably holding shutter blades. Two outer pairs of plates are shutter drive plates connected by cams to the shutter blades. Simultaneous rotation of a shutter guide plate and associated shutter drive plate causes rotation of an associated shutter blade around the light path. Rotation of a shutter drive plate while the associated shutter guide plate is stationary causes the cam to move the associated shutter blade radially. The nest is enclosed by end plates. A motor section has motors driving pinions to rotate the circular plates. The circular plates, rings pinions and shutter blades are made of sheet metal. Shutters may be provided as interleaved pairs each driven by a pair of rotatable drive plates.

13 Claims, 7 Drawing Sheets

COMPACT SHUTTER ASSEMBLY FOR A LUMINAIRE

CROSS-REFERENCE TO RELATED APPLICATION

The present application is a continuation in part of U.S. patent application Ser. No. 10/651,273, filed Aug. 28, 2003.

BACKGROUND OF THE INVENTION

The present invention relates to a shutter assembly, and particularly to an improved framing shutter assembly for a luminaire.

Theatrical luminaires can be provided with shutters to provide a projected, framed light beam of a selected shape and size. In typical arrangements, four shutter blades are mounted within the luminaire housing for movement relative to the light path. The blades can be translated radially into and out of the light path and can be rotated in the peripheral direction around of the light beam. By arranging the shutter blades, the projected light beam can be square or rectangular or have other straight sided shapes such as triangular or trapezoidal, and the projected shape can be oriented at a selected rotational position.

In the past, manually operated shutters were common. In a manually operated shutter assembly, handles projecting from the luminaire are manipulated to place the shutter blades in the desired positions. Because of the inconvenience of manual adjustment for each modification in the light beam shape, a need has arisen for a motor operated, automated, remotely controlled shutter assembly.

Existing automated shutter assemblies are subject to disadvantages. Typically, known arrangements are very complex, requiring many intricate parts and assembly operations and resulting in high material and assembly labor costs, large size and poor reliability. Large size is a problem because if a large luminaire housing is needed to contain the shutter assembly and because it may make it difficult to locate all of the shutter blades at or very close to the desired optical point such as at a focus point along the light path. In many designs the motors used for operating the shutters have been mounted for movement in the assembly and have been drivingly connected to the shutters by complicated and expensive mechanisms. A disadvantage of movably mounted motors is the need to route electrical cabling to the moving motors. There is a long standing need for a simple, inexpensive, reliable and compact framing shutter assembly for a luminaire.

U.S. Pat. No. 6,550,939 discloses a shutter apparatus of a complex design that is expensive to make and assemble. It has a number of individual shutter assemblies, each including a shutter blade that is moved by a system of shutter blade drive motors and linear driving members. In addition, a further motor is used to rotate the entire shutter system including the shutter blade drive motors and linear driving members.

BRIEF SUMMARY OF THE INVENTION

A primary object of the present invention is to provide an improved shutter assembly for a luminaire. More specific objects of the invention are to provide a framing shutter assembly that is very simple, easy and inexpensive to fabricate and assemble, reliable, and compact, thereby overcoming disadvantages of known shutter assemblies and fulfilling the long standing need for a simple, reliable and compact framing shutter assembly for a luminaire.

In brief, in accordance with the invention there is provided a framing shutter assembly for a luminaire providing a beam of light. The framing shutter assembly includes a stack of plates having aligned central openings defining a light path through the shutter assembly. The light path has a longitudinal axis and a plurality of the plates are mounted for rotation around the axis. The assembly includes a shutter blade. A first of the plurality of plates is a rotation guide plate having a guide slot extending from the central opening of the rotation guide plate. The guide slot receives the shutter blade and mounts the shutter blade for translational motion into and out of the central opening of the first plate for selectively blocking a portion of the light path. A second of the plurality of plates is a translation guide plate. A cam and follower combination includes a first camming element on the translation guide plate and a second camming element on the shutter blade engaging the first camming element and moving the shutter blade along the guide slot in response to rotation of the translation guide plate relative to rotation the guide plate.

In brief, in accordance with another feature of the invention, there is provided a framing shutter assembly for a luminaire. The shutter assembly includes a pair of flat, planar shutters each having a central opening and first and second portions located at opposite sides of the central opening. The shutters are interleaved with one another. The first portion of each shutter overlies the second portion of the other shutter.

BRIEF DESCRIPTION OF THE SEVERAL VIEWS OF THE DRAWING

The present invention together with the above and other objects and advantages may best be understood from the following detailed description of the preferred embodiment of the invention illustrated in the drawings, wherein.

DESCRIPTION OF THE INVENTION

Figure 1:
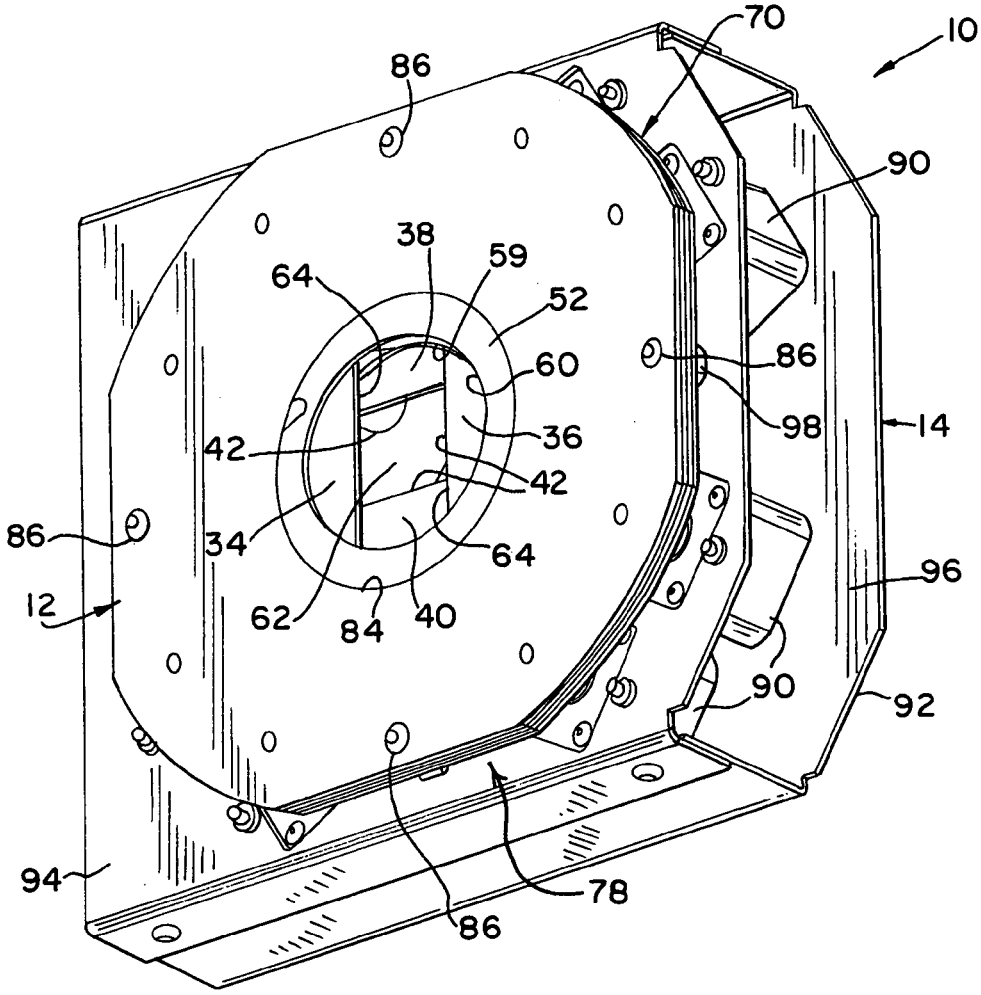
FIG. 1 is a front isometric view of a first embodiment of a shutter assembly constructed in accordance with the present invention.

Having reference now to the drawing, and initially to the embodiment of the invention seen in FIGS. 1–7, a framing shutter assembly generally designated as 10 is seen in FIG. 1. The shutter assembly 10 is constructed in accordance with the principles of the present invention and includes a shutter section 12 and a drive motor section 14. In accordance with a feature of the invention, the components of the shutter section are made from sheet metal to provide a compact and inexpensive construction that is easily fabricated and assembled, and is sturdy, simple and reliable.

Figure 2:
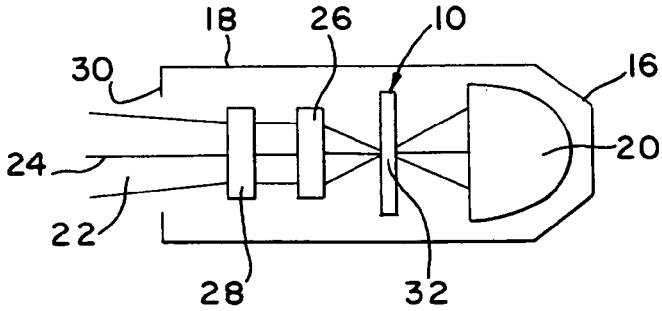
FIG. 2 is a simplified, diagrammatic view of a luminaire including the shutter assembly of FIG. 1.
Figure 3:
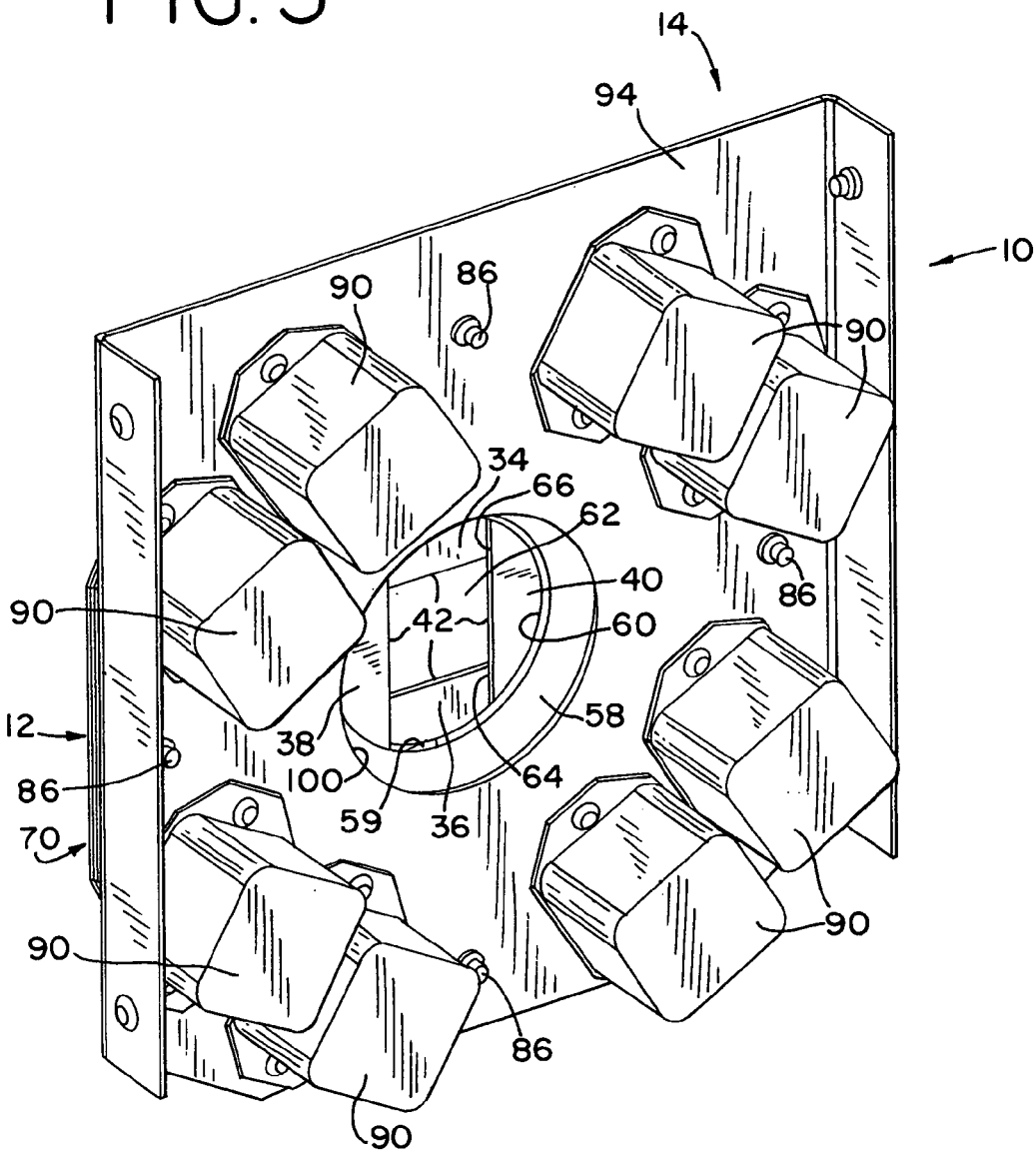
FIG. 3 is a rear isometric view of the shutter assembly with the motor housing cover removed.

FIG. 2 is a simplified diagrammatic view of a theatrical luminaire 16 provided with the shutter assembly 10 of the present invention. A luminaire housing 18 contains a light source including a reflector 20. A beam 22 of light is emitted from the reflector 20 and travels in the direction of its longitudinal axis 24 through a lens system including rear and front optical lenses 26 and 28. The light beam 22 is projected through a light exit opening 30 in the housing 18. The shutter assembly 10 is mounted within the housing 18 at a focus point 32 of the reflected light beam 22.

The framing shutter assembly 10 includes four shutter blades 34, 36, 38 and 40. Each of these blades 34–40 can be moved in a translational direction, radially inward or outward, in order to block a selected portion of the light beam 22. In addition, each of the shutter blades 34–40 can be rotated around the axis 24. The shutter blades 34–40 are preferably identical, although if desired they could differ in shape. The shutter blades 34–40 have straight inner edges 42, although other configurations are possible. The range of translational and rotational motion of the shutter blades 34–40 is such that the shutter assembly 10 can provide a projected beam of light having any three sided or four sided shape with a wide variation in size.

The shutter section 12 includes eight aligned, stacked circular plates or disks 44, 46, 48, 50, 52, 54, 56 and 58. The circular plates form a stack 59. Each of the plates 44–58 includes a central aperture 60 providing a light path 62 through the stack 59 for the light beam 22 to travel axially through the shutter assembly 10.

Four of the circular plates 44, 46, 48 and 50 are rotation guide plates, each supporting one of the shutter blades 34, 36, 38 and 40. The plates 44–50 each have a shutter guide slot 64 extending radially outward from the central aperture 60. The width of the guide slots 64 corresponds to the width of the shutter blades 34–40 and the shutter blades 34–40 are slideably received in the guide slots 64 for sliding translational motion in the radial direction relative to the light path 62.

The remaining four circular plates 52, 54, 56 and 58 are shutter drive plates. Each of the plates 52–58 has an arcuate cam slot 66. The slots 66 extend in curved, spiral like paths between radially inner and radially outer ends. Each shutter blade 34–40 has a cam follower 68 received in one of the cam slots 66. Each cam follower 68 engages only one of the cam slots 66.

Figure 4:
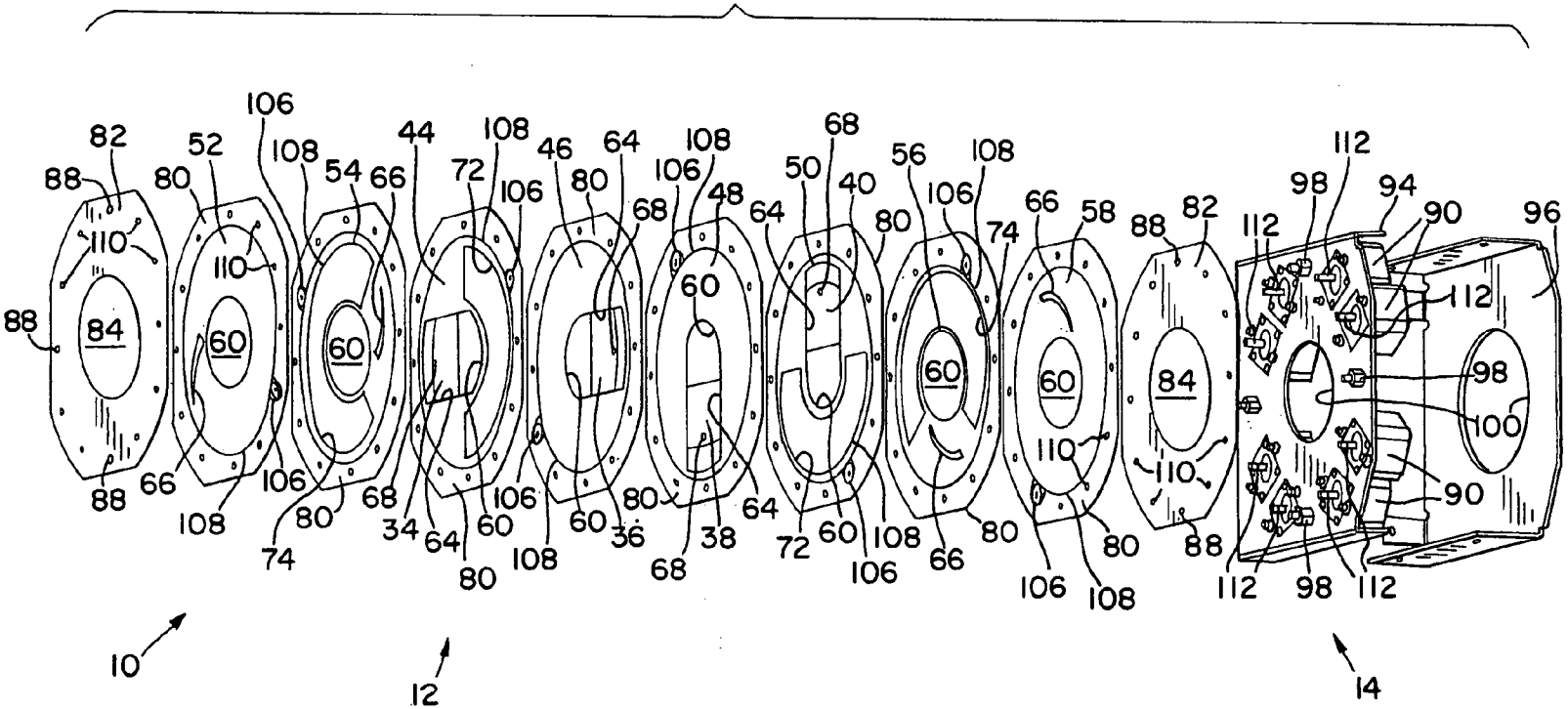
FIG. 4 is an exploded front isometric view of the shutter assembly.

The association between the shutter blades 34–40, the shutter guide plates 44–50 and the shutter drive plates is as follows (see FIG. 4).

34-44-52: shutter blade 34 slides in the guide slot 64 of the shutter guide plate 44, and the cam follower 68 of the shutter blade 34 mates with the cam slot 66 of the shutter drive plate 52.

36-46-54: shutter blade 36 slides in the guide slot 64 of the shutter guide plate 46, and the cam follower 68 of the shutter blade 36 mates with the cam slot 66 of the shutter drive plate 54.

38-48-56: shutter blade 38 slides in the guide slot 64 of the shutter guide plate 48, and the cam follower 68 of the shutter blade 38 mates with the cam slot 66 of the shutter drive plate 56.

40-50-58: shutter blade 40 slides in the guide slot 64 of the shutter guide plate 50, and the cam follower 68 of the shutter blade 40 mates with the cam slot 66 of the shutter drive plate 58.

The circular plates 44–58 are all mounted for rotation in a nest or cradle structure 70, and each can be rotated independently of the others. The shutter guide plates 44 and 50 include arcuate clearance openings 72 that permit the cam followers 68 of the shutter blades 36 and 38 to extend through the plates 44 and 50 to the cam slots 66 of their associated shutter drive plates 54 and 56. The shutter drive plates 54 and 56 include arcuate clearance openings 74 that permit the cam followers 68 of the shutter blades 34 and 40 to extend through the shutter drive plates 54 and 56 to the cam slots 66 of their associated shutter drive plates 52 and 58.

To rotate one shutter blade around the light beam axis 24, its associated shutter guide plate and shutter drive plate are rotated simultaneously. To translate one shutter blade radially with respect to the light path 62, its associated shutter guide plate is held stationary while its associated shutter drive plate is rotated. Rotation of the cam slot 66 of the rotating shutter drive plate moves the cam follower 68 of the associated shutter blade, and thus the shutter blade itself, radially in or out.

Figure 5:
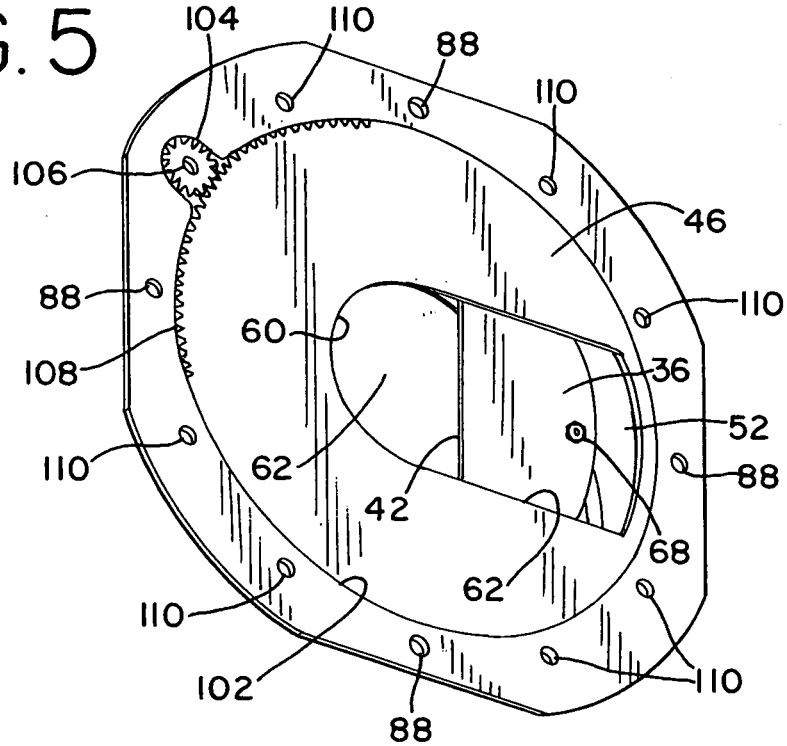
FIG. 5 is a front isometric view of one shutter subassembly of the shutter assembly including a shutter, shutter guide plate and shutter drive plate.
Figure 6:
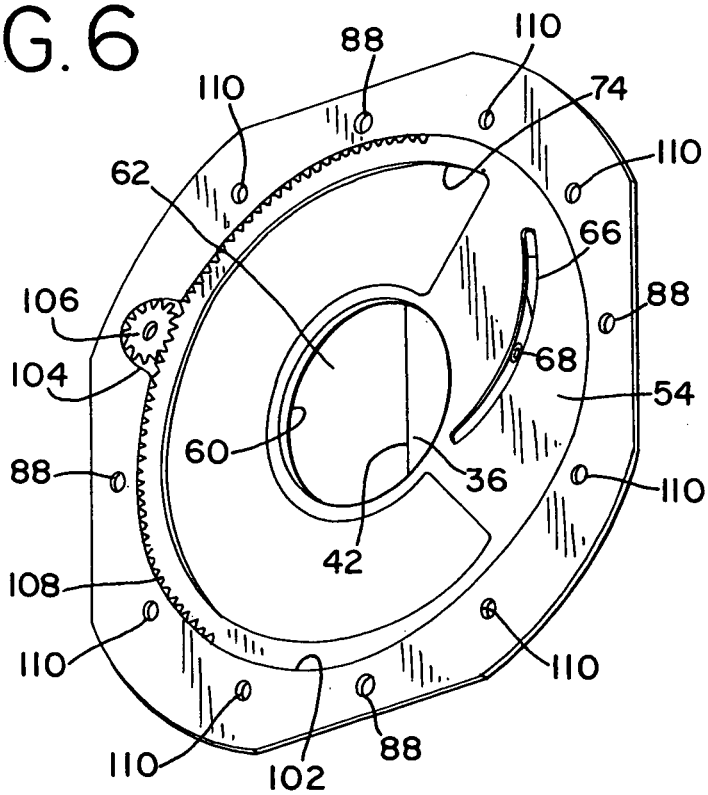
FIG. 6 is a rear isometric view of the shutter subassembly of FIG. 5.

One set of associated shutter blade 36, shutter guide plate 46 and shutter drive plate 54 is illustrated in FIGS. 5 and 6. When the shutter guide plate 46 and the shutter drive plate 54 are rotated simultaneously, the shutter blade 36 is rotated in a circular direction around the axis 24 of the light path 62, without any radial motion. When the shutter guide plate 46 is held stationary, and the shutter drive plate 54 is rotated, the rotating cam slot 66 causes the cam follower 68 on the shutter blade 36, together with the shutter blade 36, to move radially inward or radially outward, without rotational motion. If desired, combinations of radial and rotational shutter motions are also possible, for example by rotating the plates 46 and 54 at different speeds and/or in different directions.

The circular plates 44–58 are made of a flat planar material, preferably sheet metal. Similarly the shutter blades 34–40 are also made of a flat planar material, preferably sheet metal. Because of the heat of the light beam, stainless steel sheet metal is the preferred material for the shutter blades 34–40. The same stainless steel material can be used for the circular plates 44–58, or alternatively the circular plates 44–58 may be made of a less expensive steel sheet metal. The thickness of the shutter blades 34–40 does not exceed the thickness of the shutter guide plates 44–50 in order that the shutter blades can slide along the guide slots 64. The cam followers 68 can be press fit into openings 75 (FIG. 7) in the shutter blades 34–40. The cam followers 68 may be PEM® fasteners from PEM Fastening Systems, 5190 Old Easton Road, Danboro, Pa. 18916, or studs or buttons that are attached in a similar manner to in the openings 75.

Figure 7:
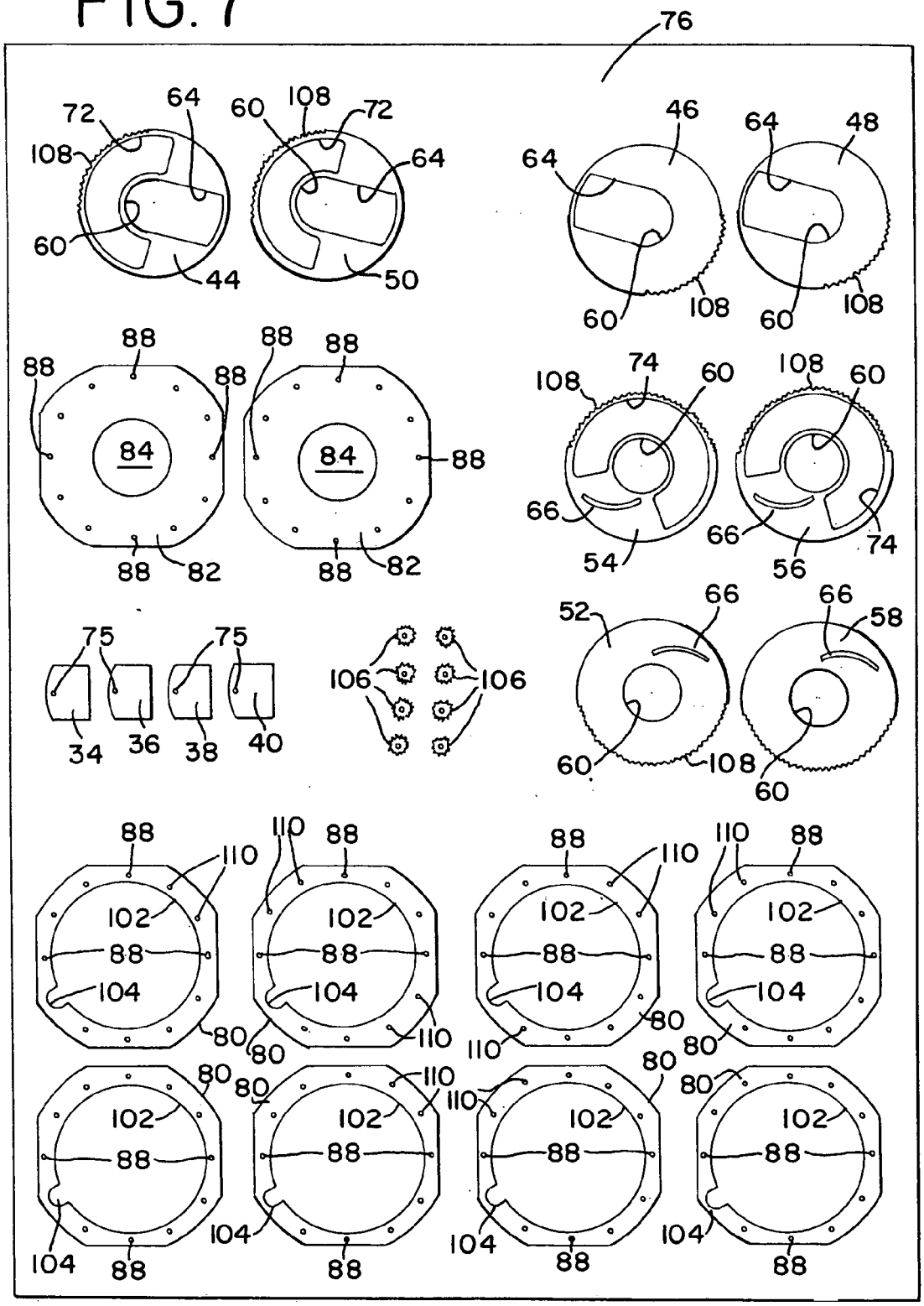
FIG. 7 is a plan view of a sheet of metal with a pattern for severing from the sheet components of the shutter assembly from the sheet.
Figure 8:
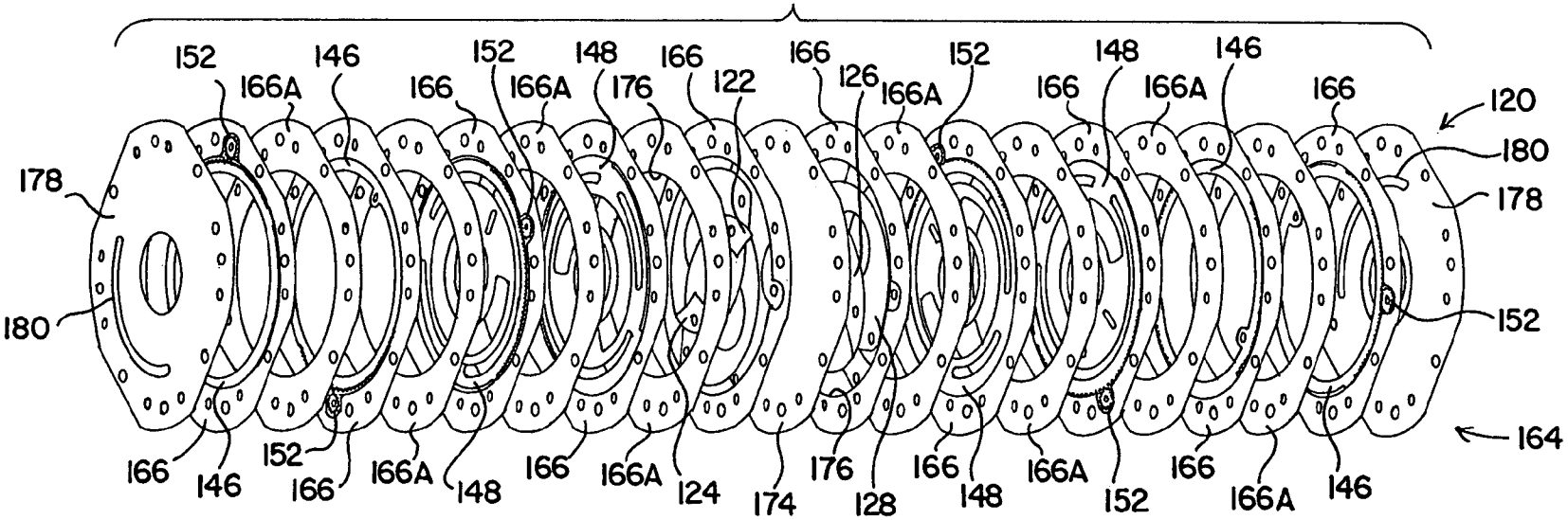
FIG. 8 is an exploded isometric view of the shutter section of a second embodiment of a shutter assembly constructed in accordance with the present invention.
Figure 10:
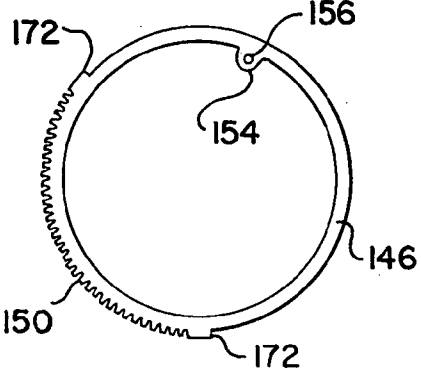
FIG. 10 is a plan view of a rotary guide plate of the shutter assembly of FIG. 8.
Figure 11:
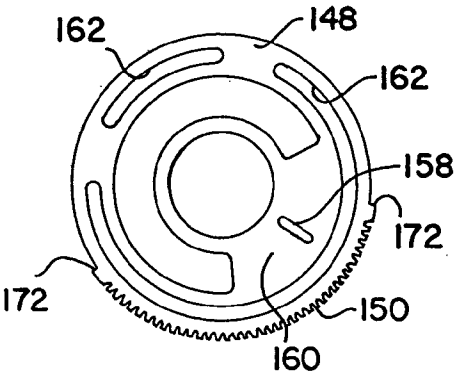
FIG. 11 is a plan view of a slot guide plate of the shutter assembly of FIG. 8.

It is preferred that the thickness of all of the circular plates 44–58 and the thickness of all of the shutter blades 34–40 is the same. This permits all of these parts to be cut or severed from a single sheet of metal. An example of this method is seen FIG. 7 where there is shown a single sheet 76 of metal illustrated with a pattern of sheet metal components for the shutter section 12 of the shutter assembly 10. The illustrated patterned parts can be severed by any desired process such as laser cutting or stamping. The pattern arrangement of FIG. 7 is for illustrative purposes only, and in actual manufacture other approaches can be taken, such as making numerous iterations of single parts in sequence from an elongated roll or web of sheet metal.

A preferred material for the sheet 76 is twenty-two gauge sheet steel having a thickness of 0.030 inch. If the shutter blades are made from more heat tolerant stainless steel sheet, their thickness can be the same. As seen in FIG. 4, the shutter guide plates 44–50 are located next to one another at the center of the stack 59. This places all of the four shutter blades 34–40 in a closely spaced array along the light beam axis. The total beam depth of the shutter blades is only 0.120 inch, so that the entire shuttering process is performed at or very close to the light beam focus point 32. This results in a clear, sharply framed, shuttered pattern of the projected light beam 22.

The stack of four shutter guide plates 44–50 is flanked in front by the shutter drive plates 52 and 54, and at the rear by the shutter drive plates 56 and 58. An advantage of the stack 59 of circular plates 44–58 is that they are self supporting in the axial direction. In addition, the shutter blades are axially captured between adjacent circular plates on both sides so that they are held in the guide slots 64 and yet are free to move radially.

The nest 70 is formed of a laminar formation 78 of a number of sheet metal rings 80. In the preferred arrangement, there are eight rings 80, equal in number to the eight circular plates 44–58. The ends of the nest 70 are closed by front and rear end plates 82. As seen in FIG. 7, the rings 80 are severed from the same metal sheet 76 as the circular plates 44–58. This has the advantage that the axial depth of the nest 70 is equal to the axial thickness of the stack 59 so that the circular plates 44–58 do not bind or become clamped tightly in the nest 70. Preferably the end plates 82 are also severed from the sheet 76. Another advantage is that sheet thickness tolerance variations from sheet to sheet do not cause clamping or binding of the circular discs 44–58.

The end plates 82 have central apertures 84 permitting the light beam 22 to travel through the shutter assembly 10. The nest 70 is held together by fasteners 86 (FIGS. 1 and 3) extending through aligned fastener holes 88 in the rings 80 and in the end plates 82. The nest 70 is assembled with the stack 59 in place within circular central holes 102 in the rings 80. Preferably a lubricant such as a dry lubricant is used in the stack 59 to reduce friction. The end plates 82 are thin enough to flex slightly and act as springs biasing the stack 59 together while permitting independent rotation of the circular plates 44–58 and radial motion of the shutter blades 34–40.

The drive motor section 14 includes eight motors 90 for independently rotating the eight circular plates 44–58. The motors 90 are enclosed in a motor housing 92 including a base 94 and a cover 96. The motors 90 are fastened to the base 94, Nuts 98 (FIG. 4) on the fasteners 86 act as stand-offs to hold the shutter section 12 spaced from and parallel to the motor housing 92. The motor housing 92 and the motors 90 are stationary, and electrical connections can easily be made to operate the motors 90. The base 94 and cover 96 include central openings 100 for passage of the light beam 22.

Fabrication cost and assembly cost of the shutter section is reduced by the use of common parts, and the number of different parts is minimal. Shutter guide plates 44 and 50 are identical. Shutter guide plates 46 and 48 are identical. Shutter drive plates 52 and 58 are identical. Shutter drive plates 54 and 56 are identical. Shutter blades 34–40 are identical. End plates 82 are identical. The eight sheet metal rings 80 are identical.

Each of the identical rings 80 includes a circular central opening 102 slightly larger than the diameter of the circular plates 44–58, and a recess 104 adjoining the central opening 102. In the laminar formation 78, the eight rings are oriented by reversing and rotating them so that the recesses are circumferentially spaced apart in a symmetrical pattern around the axis 24. Each of the recesses 104 receives a pinion gear 106. The pinion gears 106 are identical to one another and preferably are cut from the metal sheet 76 so that their thickness is the same as the thickness of the rings 80 and of the circular plates 44–58.

Each of the circular plates 44–58 is formed with gear teeth 108 for at least part of its periphery. In the stack 59, the gear teeth 108 of each circular plate 44–58 register with one of the recesses 104. Each of the pinion gears 106 meshes with the gear teeth 108 of one of the circular plates 44–58 in order to independently rotate the plates 44–58.

Each ring 80, in addition to the recess 104, includes seven drive openings 110 in the same symmetrical pattern as the pattern of recesses 104 in the formation 78. The end plates 82 also have the pattern of drive openings 110. As a result, the drive openings 108 align to form eight drive passages extending axially through the laminar ring formation 78, and each of these passages intersects one of the recesses 104.

The drive motors 90 are arrayed on the base 94 in the same symmetrical pattern as the recesses 104 and drive openings 110. Each motor 90 includes a drive shaft 112 extending into the formation 78 and drivingly engaging one pinion gear 106. The drive shafts 112 can be D shaped to engage a similar shaped central hole in the pinion gears 106. Operation of any one of the motors 90 results in rotation of the corresponding one of the circular plates 44–58.

Because the pinion gears 106 are circumferentially offset from one another, each is held in its corresponding recess 104 by the adjacent plates of the stack 59 at both sides. The gears 106 associated with the plates 52 and 58 are also held by the end plates 82. The gears 104 are therefore reliably captured in position without any additional supports or guides.

Referring now to FIGS. 8–17 of the drawings, there is illustrated a shutter section 120 that is another embodiment of the present invention. The shutter section 120 can replace the shutter section 12 of the embodiment of the invention seen in FIGS. 1–7, and can be used with the same drive motor section 14 and drive system. In addition the same materials and manufacturing technique may be used.

The shutter section 120 includes a first pair of shutters 122 and 124 and a second pair of shutters 126 and 128. The shutters of each pair are interleaved together to form a very compact, sturdy, reliable subassembly needing a minimum of external support. Each of the four shutters 122–128 has the same shape. The shutters 122–128 are made of a very thin, heat resistant, somewhat flexible, planar sheet material such as stainless steel sheet metal having a thickness of approximately 0.010 to 0.015 inch.

Figure 12:
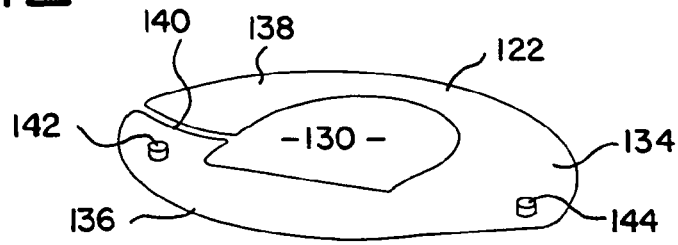
FIG. 12 is an enlarged, isometric view of a shutter of the assembly of FIG. 8.

A single shutter 122 is seen in FIG. 12. Each shutter has a central opening 130 defined in part by a straight shuttering edge 132. In the shutter section 120, the openings 130 permit the light beam 22 to travel through the shutter section 120, and the shuttering edge 132 is positioned to block and frame the light beam. Each shutter has a lobe portion 134 and a pair of arm portions 136 and 138 extending from the lobe 134 around the opening 130. The arms 136 and 138 are separated by a slot 140 extending from the opening 130 to the exterior periphery of the shutter. The arm 136 is a drive arm and is provided with a shutter drive element or pin 142. The arm 138 is a support arm. A second shutter drive pin 144 extends from the lobe 134.

Figure 13:
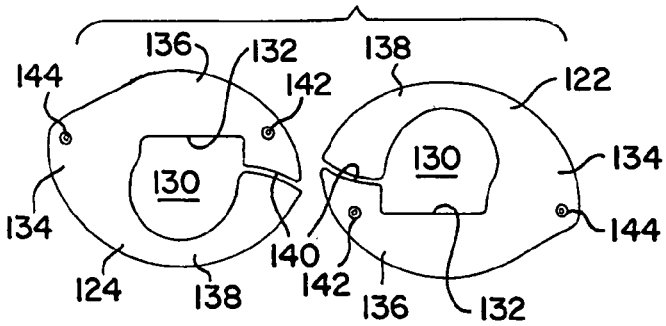
FIG. 13 is a plan view of a pair of shutters of the assembly of FIG. 8 prior to assembly.
Figure 14:
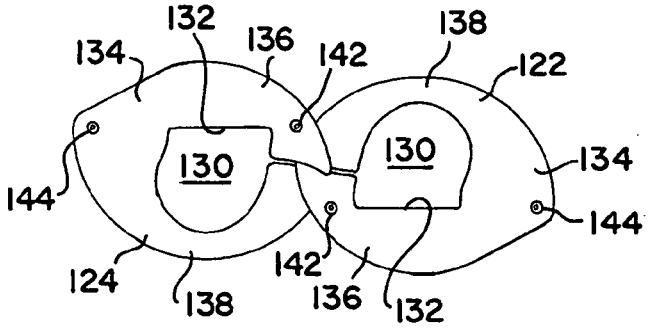
FIG. 14 is a view like FIG. 13 showing the pair of shutters at an initial stage of assembly.
Figure 15:
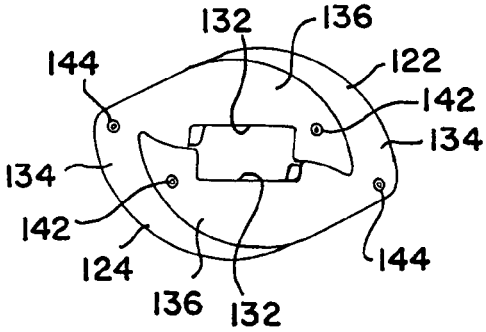
FIG. 15 is a view like FIG. 14 showing the pair of shutter blades at a subsequent stage of assembly.

The shutter pairs 122,124 and 126,128 are interleaved rather than each shutter lying in a flat plane. The assembly process of shutters 122 and 124 is seen in FIGS. 13–15 . The assembly of the other shutter pair 126, 128 is the same. In FIG. 13, the shutters 122 and 124 are aligned with each other with the slots 140 facing one another. To begin the assembly, as seen in FIG. 14, the drive arm 136 of each shutter is placed onto the support arm of the other shutter. The slot 140 of each shutter permits the arms 136 and 138 of that shutter to be flexed axially with respect to the light beam direction. The shutters 122 and 124 are moved together as seen in FIG. 15. The slot 140 of each shutter accepts the lobe portion 134 of the other shutter. In the fully assembled condition seen in FIGS. 16 and 17, the shuttering edges 132 are at opposite sides of the light beam 22.

In FIGS. 13–17 the shutters 122 and 124 are seen from the viewpoint of the light exit 30 of a luminaire in which the shutter section 120 is installed. Therefore the shutter surfaces visible in these figures are the outer surfaces. The opposite surfaces, not visible in these views, are the inner surfaces. In the interleaved assembly of shutters 122 and 124, the inner surfaces of portions of each shutter overlie the outer surfaces of other portions of each shutter. The inner surfaces of the drive arms 136 overlie the outer surfaces of the guide arms 138. The lobes 134 and the drive arm 136 of each shutter of the pair is exposed at the outer side of the shutter pair, and the drive pins 142 and 144 are accessible and extend axially from the outer side of the shutter pair. The drive pins 142 and 144 are used to move the shutters to desired positions relative to the light beam 22.

Figure 16:
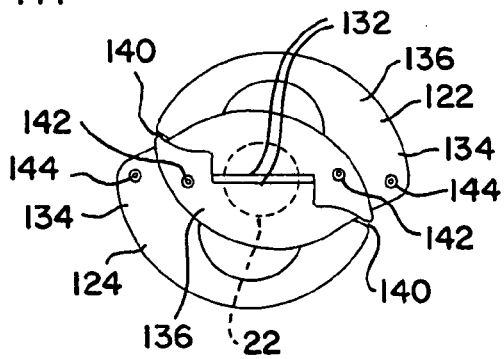
FIG. 16 is a view like FIG. 15 showing the pair of shutters in their assembled condition with the shutters positioned to frame two parallel sides of a light beam.
Figure 17:
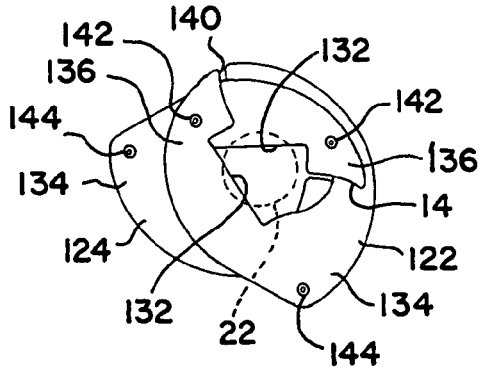
FIG. 17 is a view like FIG. 16 showing the pair of shutters positioned to frame two inclined sides of a light beam.

For example, in FIG. 16 the pins 122 and 124 are manipulated to locate the shuttering edges 132 generally parallel to one another. The axially aligned shutter pair 126, 128 can likewise be positioned to frame a square or rectangular shape. In FIG. 17, the pins 142 and 144 are manipulated to place the shuttering edges 132 at an angle to one another. A shuttering edge 132 of the other shutter pair 126,128 can be used to complete a triangle shape.

The shutter section 120 can be associated with the drive motor section 14 described above. Each shutter 122–128 is adjustably positioned relative to the light beam 22 by a pair of sheet metal shutter drive plates. The shutter section 120 includes four sheet metal rotary drive plates 146 and four sheet metal slot guide plates 148. Each shutter 122–128 is driven by one rotary drive plate 146 and by one slot drive plate 148. Each rotary drive plate 146 (FIG. 10) and each slot drive plate 148 (FIG. 11) includes peripheral gear teeth 150 meshed with one of eight drive pinion gears 152 operated as described above by one of the motors 90 of the motor section 14. The motors 90 are operated to rotate the pinion gears 152 to position the shuttering edges 132 of the four shutters 122–128 in desired positions relative to the light beam 22.

Each rotary drive plate 146 has an ear portion 154 with an opening 156 receiving the drive pin 144 of the lobe portion 134 of one of the shutters 122–128. When the rotary drive plate 146 is rotated by its corresponding pinion gear 152, the lobe portion of the corresponding shutter is rotated, i.e., moved in the peripheral direction. Each slot drive plate 148 has a drive slot 158 formed in a body section 150. The drive slot 158 receives the drive pin 142 of the drive arm 136 of one of the shutters 122–128. When the lobe drive pin 144 is rotated, the slot 158 provides clearance for the resulting radial motion of the arm drive pin 142. When the slot drive plate 148 is rotated by its corresponding pinion gear 152, the drive arm 136 of the corresponding shutter is both rotated and simultaneously moved in the radial direction.

The rotary drive plates 146 are unobstructed in their centers so that clearance is provided for drive pins 144 that may extend axially beyond a given rotary drive plate 146. The slot guide plates 148 have clearance slots 162 to provide clearance for drive pins 142 and 144 that may extend axially beyond a given slot drive plate 146.

The relationship between rotation of the pinion gears 152 and the motion of the drive pins 142 and 144 for a particular shutter 122–128 is complex because it does not resolve into simple radial and rotational components. The motors 90 and pinion gears 152 can be operated by a microprocessor based and software controlled system to position each shuttering edge 132 of each shutter 122–128 as desired to create any three or four sided light beam shape. The shuttering edges 132 can be positioned entirely out of the light beam 22 and can be positioned to block the entire light beam 22.

Figure 9:
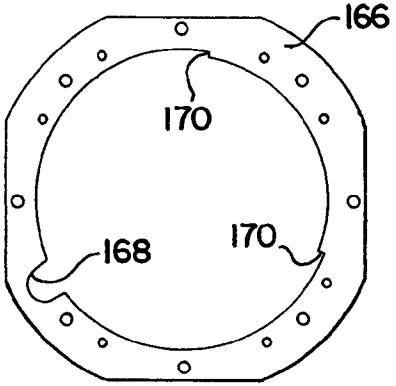
FIG. 9 is a plan view of a spacer ring of the shutter assembly of FIG. 8.

A nest 164 for the stacked drive plates 126 and 128 and for the shutters 122–128 is provided by a number of sheet metal rings 166. A typical ring 166 is seen in FIG. 9. The rings 166 may have a thickness equal to the thickness of the drive plates 146 and 148. The drive plates 146 and 148 and the rings 166 may be made by stamping from steel sheet metal stock having a thickness of about 0.030 inch.

The rings 166 surrounding the drive plates 146 and 148 each have a recess 168 positioned to receive and capture a corresponding pinion gear 152. Each ring surrounding the drive plates 146 and 148 also includes a pair of peripherally spaced stop shoulders 170 (FIG. 9) engaged by stop shoulders 172 (FIGS. 10 and 11) of the drive plates 146 and 148 to positively limit the rotational movement of the drive plates 146 and 148. Separator rings 166A are located between adjacent drive plates 146 and 148 and to the outside of each shutter pair 122, 124 and 126, 128.

The shutter pair 122, 124 is separated from the shutter pair 126, 128 by a shutter separator plate 174 so that the shutters do not interfere with one another. A ring 166 surrounds each of the shutter pairs 122, 124 and 126, 128 and cooperates with the adjacent separator ring 166A to provide pockets 176 in which the shutters can freely move. The beam depth of the assembly of shutter blades 122–126 is small, so that the shuttering process is performed at or very close to the light beam focus point. This results in a clear, sharply framed, shuttered pattern of the projected light beam 22.

The opposite ends of the nest 164 are closed by end plates 178. The plates 178 have clearance slots 180 to prevent interference with shutter drive pins 142 or 144.

In the illustrated shutter section 120, the shuttering edges 132 of the shutter pair 122, 124 can be considered to be centered in a generally horizontal position. The shutter pair

126, 128 is oriented in a transverse position so that their shuttering edges 132 can be considered to be centered in a generally vertical position. Each shutter edge can be rotated through a large range of motion to position the shuttering edges 132 in various desired offset positions so that any three or four sided frame shape can be oriented at any desired angular position.

While the present invention has been described with reference to the details of the embodiments of the invention shown in the drawing, these details are not intended to limit the scope of the invention as claimed in the appended claims.

What is claimed is:

1. A framing shutter assembly for a luminaire, said shutter assembly comprising a pair of flat, planar shutters each having a central opening and first and second portions located at opposite sides of said central opening;

said shutters being interleaved with one another, said first portion of each shutter overlying said second portion of the other shutter.

2. A framing shutter assembly as claimed in claim 1, each said first portion comprising a drive arm and each said second portion comprising a guide arm.

3. A framing shutter assembly as claimed in claim 2, each shutter including a lobe portion separating said drive and guide arms.

4. A framing shutter assembly as claimed in claim 3, each shutter including a slot separating the ends of said guide and drive arms.

5. A framing shutter assembly as claimed in claim 4, each shutter including a drive element carried by said drive arm.

6. A framing shutter assembly as claimed in claim 5, each shutter including a second drive element carried by said lobe.

7. A framing shutter assembly as claimed in claim 6 further comprising a shutter drive system for moving said drive elements.

8. A framing shutter assembly as claimed in claim 7, said shutter drive system including a plurality of rotatable drive plates generally parallel with said shutters, said drive plates including drive members engageable with said drive elements.

9. A framing shutter assembly for a luminaire providing a beam of light, said framing shutter assembly comprising:

a stack of sheet metal plates having aligned central openings defining a light path through the shutter assembly, said light path having a longitudinal axis;

a plurality of shutters mounted within said stack for radial and rotational movement relative to said longitudinal axis of said light path;

a plurality of said plates being mounted for rotation relative to one another within said stack; and drive connections between said plurality of rotationally mounted plates and said shutters for moving said shutters in response to rotation of said rotationally mounted plates.

10. A framing shutter assembly as claimed in claim 9, further comprising a nest containing said stack, and a plurality of drive motors mounted on said nest, said motors being drivingly coupled to said rotationally mounted plates.

11. A framing shutter assembly as claimed in claim 10, each of said drive motors being drivingly coupled to one of said rotationally mounted plates.

12. A framing shutter assembly as claimed in claim 9, at least a first pair of said rotationally mounted plates having guide slots, and said shutters being slideably mounted in said guide slots.

13. A framing shutter assembly as claimed in claim 9, said plurality of shutters including an interleaved pair of shutters each having a first portion overlying a second portion of the other shutter.

* * * * *